US005769112A

United States Patent [19]

Rendina

[11] Patent Number: 5,769,112

[45] Date of Patent: Jun. 23, 1998

[54] SUPPORT SYSTEM FOR FIRE HYDRANT INSTALLATION

[76] Inventor: Bruno Rendina, 103 Oswego Plains Dr., Oswego, Ill. 60543

[21] Appl. No.: 642,677

[22] Filed: May 3, 1996

[51] Int. Cl.[6] ..... F16K 51/00; B63B 35/03

[52] U.S. Cl. ..... 137/316; 137/272; 137/363; 248/68.1; 405/154

[58] Field of Search ..... 137/272, 316, 137/363, 364; 405/154; 248/68.1

[56] References Cited

U.S. PATENT DOCUMENTS

| | | | |
|---|---|---|---|
| 1,607,463 | 11/1926 | Kent | 137/316 |
| 3,385,545 | 5/1968 | Patton | 248/68 |
| 4,043,139 | 8/1977 | Scott | 405/154 |
| 4,044,428 | 8/1977 | Kowalski | 248/74 R |
| 4,183,484 | 1/1980 | Mathews | 405/154 |
| 4,805,862 | 2/1989 | Wissman | 137/272 |
| 4,981,395 | 1/1991 | Datin et al. | 405/154 |
| 4,993,670 | 2/1991 | Tesar | 248/68.1 |
| 5,328,297 | 7/1994 | Handford | 405/154 |
| 5,392,803 | 2/1995 | Bruce | 137/315 |

*Primary Examiner*—A. Michael Chambers
*Attorney, Agent, or Firm*—John L. Schmitt

[57] ABSTRACT

A support system for use in construction or repair of a fire hydrant installation includes a lower bracket and an upper bracket. The upper bracket has an adjustable hydrant riser clamp which is connected to an adjustable hydrant valve casing clamp by an adjustable spacer. The lower bracket also has an adjustable riser clamp connected by a like spacer to an upright bar. Ends of this bar then join a pair of vertically spaced apart adjustable casing clamps. As constructed in an open hole, the hydrant installation includes a hydrant riser that is positively joined to a water main and a valve casing that merely sits with a gravity fit on a hydrant valve located between the main and riser. For use, the lower bracket spacer is placed in an adjustable state allowing its respective clamps to be attached to respective lower ends of the riser and casing. Then, the lower bracket spacer is secured in place. Next, the upper bracket is attached in a like manner to respective upper ends of the riser and casing. With the brackets now secured, back filling of the hole with dirt may begin. During movement of dirt into the hole, the brackets inhibit movement of the valve casing so that the valve casing may provide operational access to the valve.

8 Claims, 2 Drawing Sheets

SUPPORT SYSTEM FOR FIRE HYDRANT INSTALLATION

BACKGROUND OF THE INVENTION

1. Field of the Invention

This invention relates generally to support systems for piping and more specifically to a support system for use in construction or repair of fire hydrant installations.

2. Prior Art

Support systems for piping are well known and have been in use for many years.

One early example of a pipe support system is disclosed in U.S. Pat. No. 325,767. This system includes a fastening plate having side flanges that form a guide for spaced apart flanges on a pair of U-shaped clamps. For use, the plate first is attached to a support structure. With the clamps fitted respectively about a pair of pipes, the clamp flanges of each clamp are slidably disposed in the plate guide flanges.

U.S. Pat. No. 3,385,545 sets out further support apparatus that is particularly adapted to positively locate a pair of conduits positioned on respective sides of a vent pipe. Attached to the vent pipe is a vent clamp having two pairs of spaced apart, side extending flanges. Ends of each side flange pair are connected by a face plate. Then, attached to each vent clamp face plate is a U-shaped conduit bracket having shanks portions formed with arcuate offsets. The offsets of each conduit bracket fit about one conduit where the bracket is compressively secured by a fastener extending through ends of each bracket shank.

A still further clamping system is shown in U.S. Pat. No. 4,044,428 and includes an elongated support channel having spaced apart side flanges. Each flange then has an inward extending hooked shaped lip. A conduit may be attached to the support channel by a U-shaped clamp defined by a pair of clamp straps. Each strap has an end stem portion that fits into the channel so that spaced apart, outward facing slots in the strap stem end may seat against the channel lips. The straps further include pairs of arcuate shaped bridge portions located to fit against respective sides of the conduit and outer ends prepared to be joined by a bolt and nut assembly.

Lastly, a recent "universal" bracket assembly for gas risers is disclosed in U.S. Pat. No. 4,993,670. This assembly includes a pair of L-shaped elements. Depending on use, these elements are placed in a shallow U-shaped form, a T-shaped form, or L-shaped form. A flange and elongated leg of each element are prepared with openings for fastening the elements to a support structure or insertion of U-bolts that fit about from one to three gas risers.

SUMMARY OF THE INVENTION

A support system of this invention, which particularly adapted for use in construction or repair of a fire hydrant installation, includes a lower bracket and an upper bracket. This installation, typically located in an open hole in the ground, includes a fire hydrant attached to a top end of a vertically positioned hydrant riser having a bottom end connected through an elbow to an outlet of a valve. An inlet of the valve then connects with a water main through a nipple connector. Seated on the valve is an upright casing that provides access to the valve when the installation subsequently is covered with dirt.

The lower bracket of this inventive support system includes two aligned, vertically spaced apart valve casing clamps connected by a bar. The bar then is joined by an adjustable horizontal spacer to an adjustable hydrant riser clamp.

The upper bracket of the system has a like adjustable riser clamp and a single like valve casing clamp that are connected by a like horizontal adjustable spacer.

For use, first the riser clamp of the lower bracket is fitted about a lower end of the riser and attached to such. Next, with the lower bracket spacer in an adjustable state, the lower bracket pair of casing clamps is attached to a lower end of the casing. Then, the lower bracket spacer is secured to positively join the lower end of the casing to the lower end of riser. With the lower bracket in place, the upper bracket riser clamp and casing clamp are attached to respective upper ends of the riser and casing. Where the casing upper end is adjustable, the upper bracket casing clamp is not fully tightened thereabout. Lastly, the upper bracket spacer is placed in a secure state.

The support system of this invention alleviates several problems associated with present day construction or repair of fire hydrant installations.

To appreciate the improvement provided by this inventive system, one must understand that there is no positive linkage to secure the valve casing to the valve. The bottom end of the casing merely rests on the value with a gravity fit. Theretofore, a construction laborer descended into the hole in which the valve and casing were located and manually held the casing during back filling.

Even during periods of dry weather and solid footing, standing in a hole being filled with dirt by a large piece of equipment is not ideal. First, the filling dirt may dislodge the valve casing in spite to the best efforts of the laborer. Secondly, laborers performing this task are subject to injury from, for example large stones in the fill material or collapse of a side of the hole from weight of the back filling equipment. During wet weather or in the presence of ice, snow, and freezing temperatures, the chance of mishap only increases.

A first positive feature of the support system is that the system brackets are easy to install and installed without use of tools. During attachment of the brackets there is a minimal number of loose parts. Additionally, the bracket clamps may readily accommodate different size hydrant risers and valve casings. Further, the system brackets may be fitted to risers and casing located apart at different distances.

But, of significant importance, this inventive support system, once installed, maintains the valve casing in place during back filling. Thus, there is no need for a laborer to stand in the hole and hold the valve casing until there is sufficient fill in the hole to secure the casing in place. When back filling is complete, the casing bottom end remains properly located on the valve for insertion of a long handle tool into the casing to engage and operate the valve.

Also noted above, where the upper end of the casing is adjustable, the upper bracket casing clamp is attached to the casing upper end with a stabilizing but less than absolutely tight fit. Then, when the installation hole has been covered with fill, the casing upper end may be threadedly adjusted up or down to align a top opening of the casing with the grade level.

DESCRIPTION OF THE PREFERRED EMBODIMENT

Figure 1:
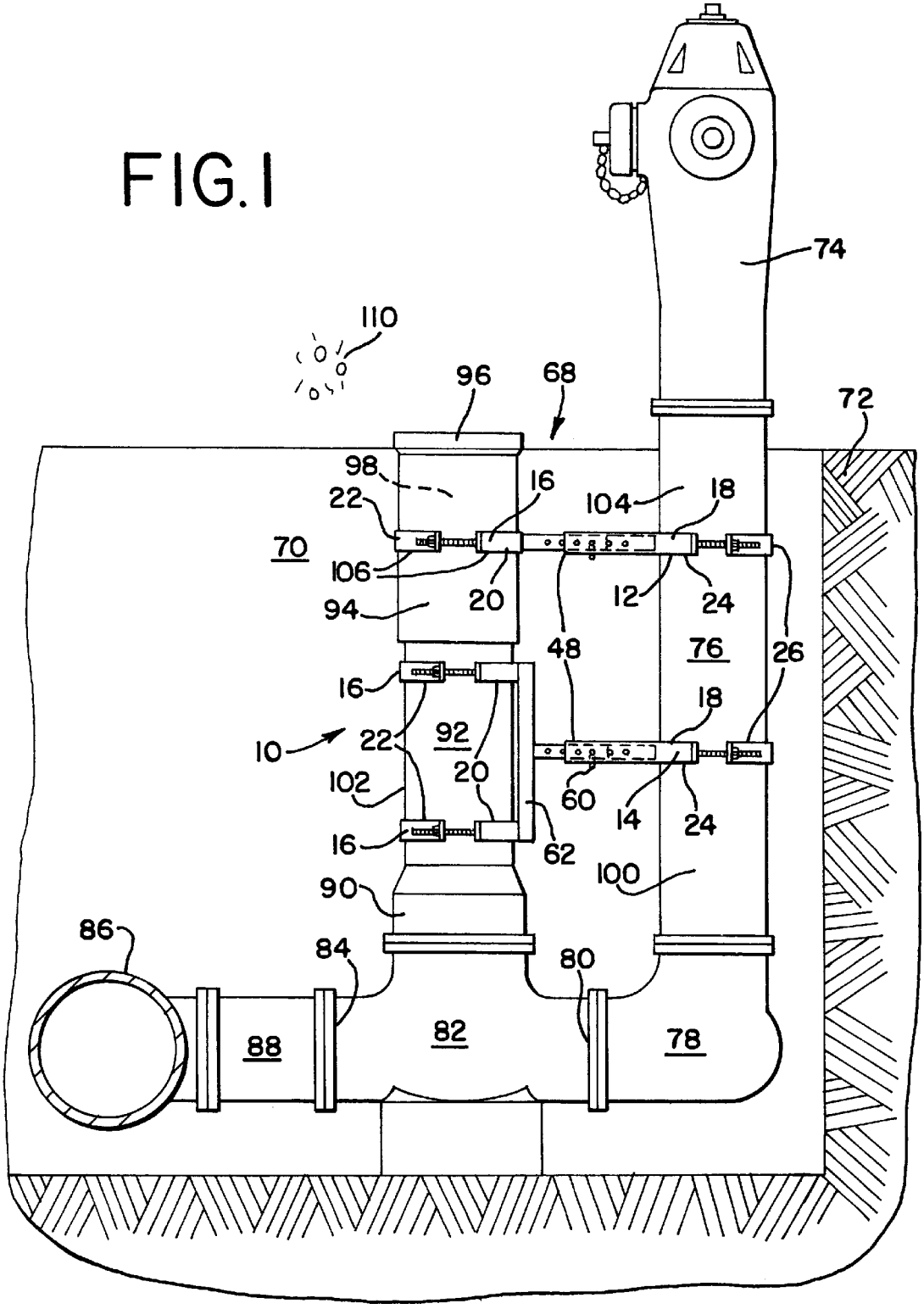
FIG. 1 is a side elevation view of a support system of this invention assembled to a hydrant riser and a valve casing of a fire hydrant installation located in a hole that is ready for back filling.
Figure 2:
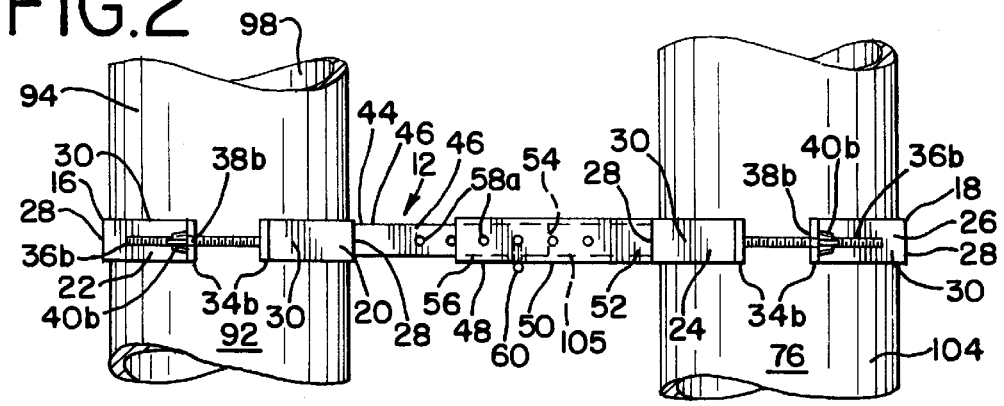
FIG. 2 is a side elevation view of an installed upper bracket of the support system.
Figure 3:
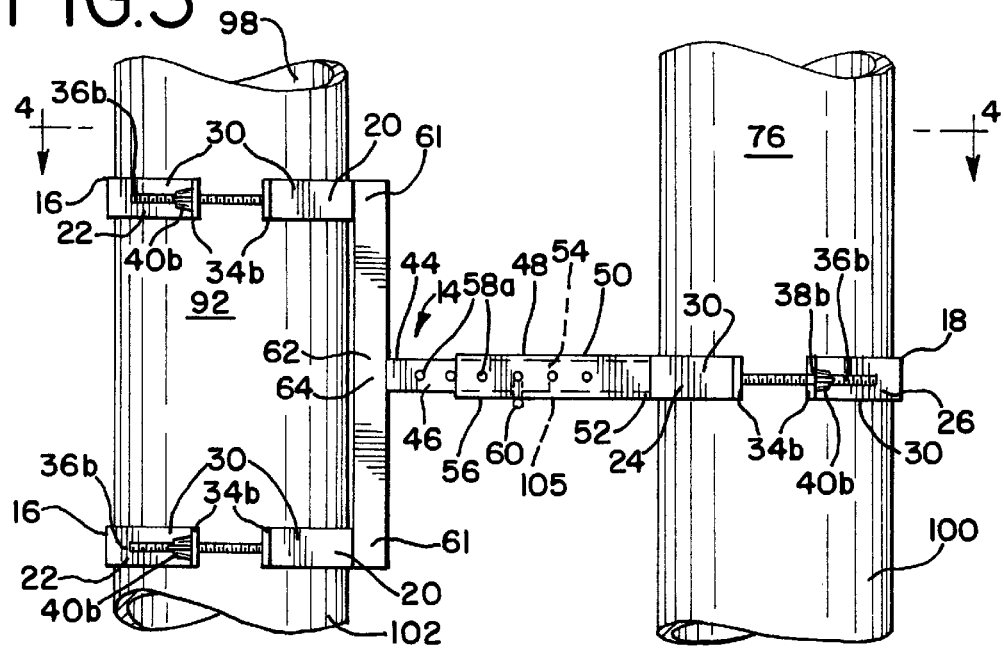
FIG. 3. is a side elevation view of an installed lower bracket of the support system.
Figure 4:
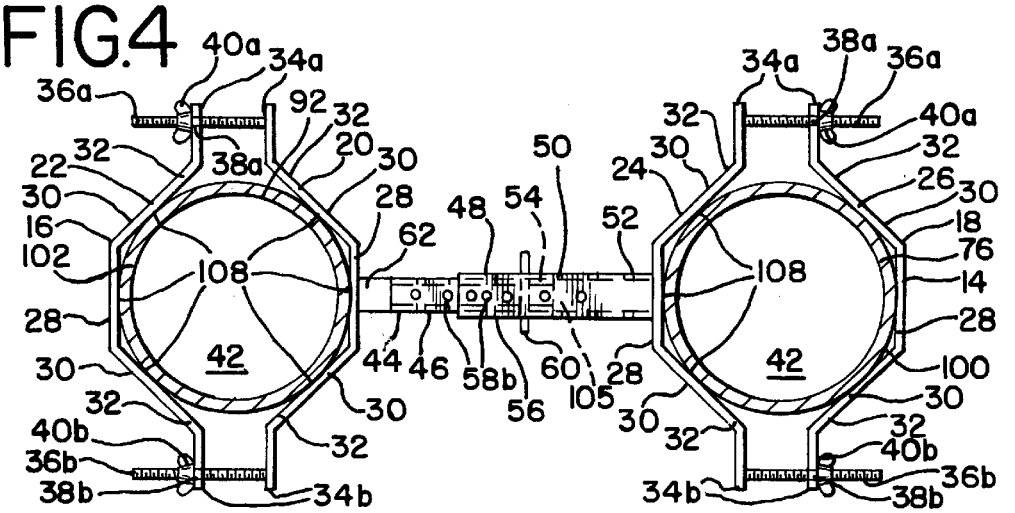
FIG. 4. is a sectional view as seen generally alone the line 4—4 in FIG. 3.

A support system of this invention, which is particularly adapted for use in construction or repair of a fire hydrant installation, is shown generally in FIG. 1 and designated 10. The support system 10 includes an upper bracket 12 and a lower bracket 14, which are shown in detail in FIGS. 2–4.

The upper bracket 12 is defined by a hydrant valve casing clamp 16 and a hydrant riser clamp 18. The casing clamp 16 has an inner portion 20 and an outer portion 22. The riser clamp 18, in a like manner, has an inner portion 24 and an outer portion 26. Each clamp inner and outer portion 20–26 has a segmented, bowl-like shape.

The casing clamp inner portion 20 then includes a center bar section 28 that connects a pair of spaced apart, angularly positioned intermediate bar sections 30. Joining respective outer ends 32 of the intermediate bar sections 30 are laterally projecting flange bars 34*a*, 34*b*. Then, attached to and projecting outwardly respectively from each flange bar 34*a*, 34*b* is a respective threaded rod 36*a*, 36*b*.

The casing clamp outer portion 22, having a similar structure as the inner portion 20, also includes a center bar section 28, connecting intermediate bar sections 30, and attached flange bars 34*a*, 34*b*. Each casing clamp outer portion flange bar 34*a*, 34*b* is formed with a respective aperture 38*a*, 38*b* to loosely received the threaded rods 36*a*, 36*b* of the clamp inner portion 20. Wings nuts 40*a*. 40*b* on respective threaded rods 36*a*, 36*b* join the clamp inner and outer portions 20, 22 together to form an adjustable space 42 therebetween.

The inner and outer portions 24, 26 of the riser clamp 18 of the upper bracket 12 are defined by structure like that of the upper bracket casing clamp portions 20, 22. Therefore, the structure of this riser clamp 18 need not be described. Like reference numbers are used to identify like structure drawings.

Attached to the center bar section 28 of the upper bracket casing clamp inner portion 20 is an outer end 44 of a square shaped slide member 46. This slide member 46 forms part of a horizontally positioned adjustable spacer 48. The spacer 48 further includes a hollow, square shaped guide member 50 having an outer end 52 attached to the riser clamp inner portion center bar section 28. An inner end 54 of the spacer slide member 46 is telescopically disposed in an inner end 56 of the guide member 50. The slide member 46 and the guide member 50 are each formed with a set of horizontally aligned, spaced apart apertures 58*a* and a set of vertically aligned, spaced apart apertures 58*b*. The apertures 58*a*, 58*b* of each set are located on one inch centers. The apertures 58*a* of one set then are offset from the apertures 58*b* of the other set to provide one-half inch slide member-guide member aperture alignment. A pin 60 is inserted through selectively aligned apertures 58*a* or 58*b* of the spacer members 46, 50 to affix the distance between the clamps 16, 18 of the system upper bracket 12. Note that the upper bracket 12 is invertible.

The lower bracket 14 of the support system 10 includes a pair of vertically aligned and spaced apart casing clamps 16 that are similar to the casing clamp 16 of the upper bracket 12. The center bar sections 28 of the lower bracket casing clamp inner portions 20 are connected to ends 61 of an upright bar 62 that locates these casing clamps 16 about one foot apart.

The lower bracket 14 further includes a riser clamp 18 having an inner and an outer portion 24, 26 like the riser clamp portions 24, 26 of the upper bracket 12. Again, there is no need to repeat the description of such, but like reference numbers are used to identify like structure.

Attached to a middle 64 of the upright bar 62 is an outer end 44 of a slide member 46 of a lower bracket adjustable spacer 48. This lower bracket spacer 48 also is positioned horizontally and includes a guide member 50 having an outer end 52 attached to the center bar section 28 of the inner portion 24 of the lower bracket riser clamp 18. In a like manner as the upper bracket spacer 48, an inner end 54 of the lower bracket spacer slide member 46 is slidably disposed inside an inner end 56 of the lower bracket spacer guide member 50. Each lower bracket spacer member 50, 52 then has like sets of spaced apart apertures 58*a*, 58*b* for insertion of a further pin 60 on one-half inch increments.

As noted above, the support system 10 is particularly adapted to simplify construction of fire hydrant installations or repair of such. A fire hydrant installation is shown typically in FIG. 1 and designated 68. As shown, the installation 68 is located in an open hole 70 in the ground 72 and includes a fire hydrant 74 attached to a top end of a hydrant riser 76. A bottom end of the riser 76 is connected by an elbow 78 to an outlet opening 80 of a hydrant valve 82. An inlet opening 84 of the valve 82 then is joined to a water main 86 by a connecting nipple 88. As thus constructed, the riser 76 and the main 86 are positively linked. Sitting on the valve 82 with a gravity fit is a bell-shaped bottom end 90 of a valve casing 92. As seen in FIG. 1, the casing 92 has an optional thread-adjustable upper end 94. This adjustable upper end 94 allows leveling a closable top opening 96 of the casing 92 with grade level. An inner passageway 98 in the casing 92 provides operative access to the valve 82 by long handle tool.

Application of the support system 10 to the installation 68 begins by attaching the lower bracket riser clamp 18 to a lower end 100 of the riser 76. To effect this attachment, first one of the riser bracket wing nuts, for example nut 40*a*, is removed from its threader rod 36*a*, and the other wing nut 40*b* then is positioned on its rod 36*b* so that the clamp outer portion flange bar 34*a* may swing clear from its threaded rod 36*a*. Next, the riser clamp portions 24, 26 are fitted about the riser lower end 100 allowing reinsertion of the threaded rod 36*a* in its flange aperture 38*a* and reattachment of the nut 40*a*. Lastly, the lower bracket riser clamp 18 secured to the riser 76 by compression of the nuts 40*a*, 40*b* against the clamp outer portion flanges 34*a*, 34*b*. Note that the outside diameter of the riser 76 will vary from 7¾ in. to 9¼ in.

With the lower bracket spacer pin 60 removed and the outer portion 22 of each casing clamp 16 partially freed as described above, the inner and outer portions 20, 22 of each lower bracket casing clamp 16 are fitted about a lower end 102 of the casing 86 located immediately above the casing bell-shaped end 90. Note that the outside diameter of the casing lower portion typically is 6½ in. The two wings nuts 40*a*, 40*b* of each casing clamps 16 then are compressively threaded against their respective clamp outer portion flange bars 34*a*, 34*b* to secure the casing clamp portions 20, 22 to the casing lower end 102. Lastly, the pin 60 is inserted through pairs of aligned apertures 58*a* or 58*b* in the lower bracket spacer 48 so that the lower bracket 14 positively connects the casing lower end 102 to the riser lower end 100. Typically, there is from a 3 in. to 6 in. overlap between the spacer member inner ends 54, 56 to form a substantial area 105 of contact therebetween.

If there were no initial spacer member aperture alignment, such alignment is obtained by first loosening the riser clamp nuts 40*a*, 40*b* until there is aperture alignment, next inserting the pin 60, and then retightening the riser clamp nuts 40*a*, 40*b*.

Except as discussed below, the upper bracket 12 attaches to an upper end 104 of the riser 76 and the upper end 94 of the casing 92 in a like manner as the lower bracket 14. As mentioned above, the casing upper end 94 may be adjustable in which case the outside diameter of the casing upper end 94 typically is 7½ in. In this case, a fit 106 between the upper bracket casing clamp 16 and the casing upper end 94 is reduced to less than absolutely tight. This slightly loose or firm fit 106 allows rotation of the casing upper end 94 to adjust the height location of the casing top end opening 96 to grade level.

As attached, there are from four to six lines of contact 108 between the inner and outer portions 24, 26 of each riser clamp 18 and the riser 76 and between each casing clamp 16 and the casing 92. The exact number of lines of contact 108 depends primarily on the diameter of the riser 76 and that of the casing 92. The larger the diameter, fewer is the number of contact lines 108. In each case, the lines of contact 108 are located incrementally thereabout. Therefore, as discussed above, the casing-upper bracket casing clamp fit 106 forms firm, not tight, lines of contact 108.

With the brackets 12, 14 now in place to positively hold the casing 92, backing filling of dirt 110 into the hole 70 may begin. Typically, the dirt 110 is pushed into the hole 70 in a direction in-line with the casing 92 and the riser 76. This inline movement of the dirt 110 produces compressive or tensile dislodging forces. These forces transfer evenly from the casing 92 to the casing clamps 16 through the casing clamp lines of contact 108. From the casing clamps 16 the dislodging forces then shift to the riser clamps 18 where the forces again distribute evenly to the riser 76 through the riser clamp lines of contact 108. The dislodging forces stress the riser 76 so that the riser 76 produces equal stabilizing forces that transfer back in an opposite direction. Note that these forces also produce stress on the spacer pins 60. Because each pin 60 is located in two pairs of aligned aperture 38a or 38b, stress on a pin 60 remains below a level that could shear that pin 60.

Where movement of the dirt 110 is in a non-aligning direction, such movement produces twisting dislodging forces on the casing 92. These twisting dislodging forces transfer in a like manner from the casing 92 to the riser 76 that is stressed to produce equal and opposite stabilizing forces. These twisting forces also stress on the spacer members 46, 50. Because of the large area 105 of contact between the inner ends 54, 56 of the spacer members 46, 50, stress on the spacer members 46, 50 remains below deformation level.

When the hole 70 is full of dirt 110, the casing bottom end 90 remains properly seated on and aligned with the hydrant valve 82 allowing valve operation to regulate the flow of water from the water main 86 to the hydrant 74.

While an embodiment, uses, and advantages of this invention have been shown and described, it should be understood that this invention is limited only by the scope of the claims. Those skilled in the art will appreciate that various modifications or changes may be made without departing from the scope and spirit of the invention, and these modifications and changes may result in further uses and advantages.

What I claim is:

1. A support system for use in construction or repair of a fire hydrant installation located in an open hole, said system comprising:

bracket means for supporting a valve casing of said installation, said bracket means having a casing clamp formed with an adjustable inner and an outer portion to fit about a casing of said installation to produce incrementally spaced apart lines of contact with said casing, a riser clamp having an adjustable inner and an outer portion to fit about a riser of said installation to produce incrementally spaced apart lines of contact with said riser, and a spacer having a pair of interacting members longitudinally adjustable to accommodate a selective distance between said casing and said riser with an outer end of one said spacer member joined to said casing clamp inner portion and an outer end of said other spacer member joined to said riser clamp inner portion, wherein for use said bracket is attached to said casing and said riser, said spacer members secured in a fixed location, and dislodging forces on said casing resulting from back filling of said installation open hole are resisted by stabilizing forces transmitted from said riser to said casing through said riser-riser clamp lines of contact and said casing-casing clamp lines of contact to maintain said casing seated on and aligned with a valve of said installation.

2. A support system as defined by claim 1 and further characterized by said bracket means including, an upper bracket having one said casing clamp and one said riser clamp connected by one said spacer, and a lower bracket having a pair of said casing clamps spaced vertically apart by an upright bar having one end joined to one said casing clamp inner portion and an opposite end of said bar joined to said other casing clamp inner portion, one said riser clamp, and one said spacer connecting said riser clamp to a middle of said upright bar.

3. A support system as defined by claim 1 and further characterized by, said casing clamp having a structure like said riser clamp.

4. A support system as defined by claim 3 and further characterized by, said inner portion of each said clamp including a middle bar section connecting a pair of spaced apart, angularly positioned intermediate bar sections having outer ends respectively joined to laterally projecting flange bars, and an outwardly extending threaded rod carried on each said flange bar, and said outer portion of each said clamp including a middle bar section connecting a pair of spaced apart, angularly positioned intermediate bar sections having outer ends respectively joined to laterally projecting flange bars, and an aperture formed in each said outer portion flange bar to receive one said inner portion threaded rod.

5. A support system as defined by claim 1 and further characterized by, one said member of said spacer being a square-shaped slide member and said other member of said spacer being a hollow, square-shaped guide member with an inner end of said slide member telescopically disposed in an inner end of said guide member to form a substantial area of engagement therebetween, and said spacer members being formed with alignable, spaced apart apertures for insertion of a pin for securing said spacer members in said fixed location.

6. A support system as defined by claim 5 and further characterized by, said spacer member apertures being defined by a set of spaced apart, vertically aligned pairs of apertures and a set of spaced apart, horizontally aligned pairs of apertures.

7. A support system for a valve casing forming part of a fire hydrant installation, said system comprising:

a lower bracket having an riser clamp defined by adjustable inner and outer portions to compressively fit about a lower end of a riser of said installation, a pair of vertically spaced apart casing clamps each having adjustable inner and outer portions to compressively fit about a lower end of said casing, an upright bar having ends respectively joined to an inner portion of each said casing clamp, and spacer means connecting said upright bar to said riser clamp, said spacer means allowing selective longitudinal positioning of said casing clamps and said riser clamp to allow attachment of said clamps to said riser and said casing and then positive joining of said casing lower end to said riser lower end, and an upper bracket having a riser clamp defined by adjustable inner and outer portions to compressively fit about an upper end of said riser, a casing clamp having adjustable inner and outer portions to fit about an upper end of said casing and form a selective fit with said casing upper end allowing elevational adjustment of said casing upper end, and spacer means connecting said upper bracket riser clamp to said upper bracket casing clamp, said upper bracket spacer means allowing selective longitudinal positioning of said upper bracket casing clamp and said upper bracket riser clamp to allow attachment of said upper bracket clamps to said riser and said casing and then positive joining of said casing upper end to said riser upper end, wherein said brackets maintain a location of said casing during back filling of a hole about said installation.

8. A support system for a fire hydrant installation including a vertically positioned hydrant riser having a lower end positively connected through a valve to a water main and a vertically positioned valve casing having a bottom end fitting on said valve with a gravity fit, said system comprising:

a lower bracket having an riser clamp defined by segmented bowl-shaped inner and outer portions compressively attached to said lower end of said riser, a pair of spaced apart casing clamps with each said casing clamp having segmented bowl-shaped inner and outer portions compressively attached to said lower end of said casing, a bar having ends respectively joined to said inner portions of said casing clamps, and an adjustable spacer connecting said bar to said riser clamp, and an upper bracket having an riser clamp defined by segmented bowl-shaped inner and outer portions attached to an upper end of said riser, a casing clamp having segmented bowl-shaped inner and outer portions attached to upper end of said casing, and a spacer connecting said upper bracket riser clamp to said upper bracket casing clamp, wherein during back filling of a hole formed about said hydrant installation said brackets of said system inhibit dislocation of said casing by movement of dirt into said hole so that upon completion of said back filling said casing provides operative access to said valve from grade level.

* * * * *